US005979992A

United States Patent [19]

Calderone et al.

[11] Patent Number: 5,979,992

[45] Date of Patent: Nov. 9, 1999

[54] HUB AND WHEEL ASSEMBLY FOR AN IN-LINE SKATE

[76] Inventors: Anthony M Calderone; Christopher M Calderone; Anthony J Calderone; Douglas W Calderone, all of 59 Buttonwood La., Levittown, Pa. 19054

[21] Appl. No.: 08/958,063

[22] Filed: Oct. 27, 1997

[51] Int. Cl.[6] ..... B60B 5/02

[52] U.S. Cl. ..... 301/5.3; 152/323

[58] Field of Search ..... 301/5.3, 5.7, 64.7; 280/11.22, 11.23; 152/323, 393, 394

[56] References Cited

U.S. PATENT DOCUMENTS

| | | | |
|---|---|---|---|
| 1,576,924 | 3/1926 | Malloy | 152/394 X |
| 2,766,802 | 10/1956 | Grobowski | 301/64.7 X |
| 5,310,250 | 5/1994 | Gonsior | 301/5.33 |
| 5,320,418 | 6/1994 | Chen | 301/5.3 |
| 5,388,623 | 2/1995 | Homma et al. | 301/5.3 X |
| 5,401,037 | 3/1995 | O'Donnell | 280/11.2 |
| 5,560,685 | 10/1996 | DeBortoli | 301/5.3 |
| 5,573,309 | 11/1996 | Bekessy | 301/5.3 |
| 5,660,447 | 8/1997 | Angelici | 301/5.7 |

*Primary Examiner*—Russell D. Stormer
*Attorney, Agent, or Firm*—LaMorte & Associates

[57] ABSTRACT

A wheel assembly for use on wheeled devices such as in-line skates. The wheel assembly includes a hub having plurality of support elements radially extending from the exterior of the hub. Each of said plurality of support elements has a first end that is connected to the hub and second end that faces away from the hub. The second end of adjacent support elements are separated by a gap. A wheel is molded to the hub. The material of the wheel envelops the support elements. AS a result, certain sections of the molded wheel are reinforced by the support elements, while others are not. Preferably each of the support elements terminates on the circumference of a common imaginary circle, wherein the support elements account for between 20% and 75% of the circumference of the common imaginary circle.

7 Claims, 2 Drawing Sheets

HUB AND WHEEL ASSEMBLY FOR AN IN-LINE SKATE

BACKGROUND OF THE INVENTION

1. Field of the Invention

The present invention relates to wheel assemblies for in-line skates. More particularly, the present invention is related to the hub structure of a wheel assembly and how the hub structure effects the performance of the surrounding wheel.

2. Description of the Prior Art

In recent years in-line skates have become increasingly popular. There now exist many professional and semi-professional sport activities where the players wear in-line skates. For example, there are roller hockey leagues, speed skating competitions and the like.

Like with many different sports, when the athletic abilities of different competitors are evenly matched, it is often the quality of that player's equipment that determines who will win and who will loose the competition. In sports that use in-line skates, it is commonly the quality of the skate that mostly effects the performance of the athlete.

One of the most important features of an in-line skate is the wheel assembly. The wheel assembly is comprised of a hub that spins on an axle and the wheel that is molded onto the hub. The wheel is the portion of the skate that actually contacts the ground. In order to preform well, the material of a wheel must embody two characteristics. First, the wheel must be able to grip the ground when a person is turning or stopping, thereby optimizing control. Secondly, the material of the wheel must minimize the drag of friction against the ground when a person is skating straight, thereby optimizing speed. The ability of the wheel to grip the ground when turning, yet be of low friction when skating straight are diametrically opposed properties. Consequently, most every wheel assembly design selects a compromise where neither speed nor control are optimized.

In the prior art, a common method of changing the performance of a wheel is to alter the composition of the material of the wheel. If a soft material were used in the manufacture of the wheel, the wheel would grip the ground well and the ability of the wheel to turn and stop would be greatly enhanced. However, soft materials typically do not wear well. Furthermore, the soft material would significantly slow the speed of the skates. If a hard material were used in the manufacture of the wheel, the wheel would have a low coefficient of friction and would wear well. However, the wheel would have a tendency to slide along the ground when a person tried to turn sharply or stop. It is for these reasons that most in-line skates used a medium hardness plastic composition for molding the wheels. A medium hardness plastic wheel have an average wear life, an average ability to turn and an average speed capacity.

In an attempt to optimize performance, wheel assembly designers have altered the shape of the hub in the center of a wheel assembly so that the hub shape effects the performance of the wheel. In such prior art designs, a relatively soft material is used in the manufacture of the wheel. However, the hub is designed to extend into the material of the wheel and limit the deflection of the wheel. As a result, the soft material provides good turning ability, while the hub prevents excessive deformation of the wheel and allows for greater speed. Such prior art wheel assemblies are exemplified by U.S. Pat. No. 5,320,418 to Chen, entitled Skate Wheel Structure, and U.S. Pat. No. 5,573,309 to Bekessy, entitled In-Line Roller Skate Wheel Assembly. Such prior art designs do improve the performance of the wheel assembly, however, both speed and turn performance are still greatly compromised.

A need therefore exists in the art for a wheel assembly for an in-line skate that comes closer to optimizing both speed and turning performance. This need is met by the present invention as described and claimed below.

SUMMARY OF THE INVENTION

The present invention is a wheel assembly for use on wheeled devices such as in-line skates. The wheel assembly includes a hub having plurality of support elements radially extending from the exterior of the hub. Each of said plurality of support elements has a first end that is connected to the hub and second end that faces away from the hub. The second end of adjacent support elements are separated by a gap.

A wheel is molded to the hub. The material of the wheel envelops the support elements. As a result, certain sections of the molded wheel are reinforced by the support elements, while others are not. Preferably each of the support elements terminates on the circumference of a common imaginary circle, wherein the support elements account for between 20% and 75% of the circumference of the common imaginary circle. In such an configuration, areas supported and not supported by support elements are alternate as the wheel assembly spins. At such an alternating cycle rate, the characteristics of the supported areas and the unsupported areas become mixed in a manner that tends to optimize both characteristics. The result is wheel assembly that grips tightly in turns, yet is exceptionally fast when skating straight. The wheel assembly also exhibits long wear resistance, yet provides rapid stops without undue skidding.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention can be used in the production of many different types of wheel assemblies, such as skate board wheels, wagon wheels and the like, the present invention is particularly well suited for use as a skate wheel. Accordingly, by way of example, the present invention will be described in the embodiment of a skate wheel in order to set forth the best mode contemplated for the invention.

Figure 1:
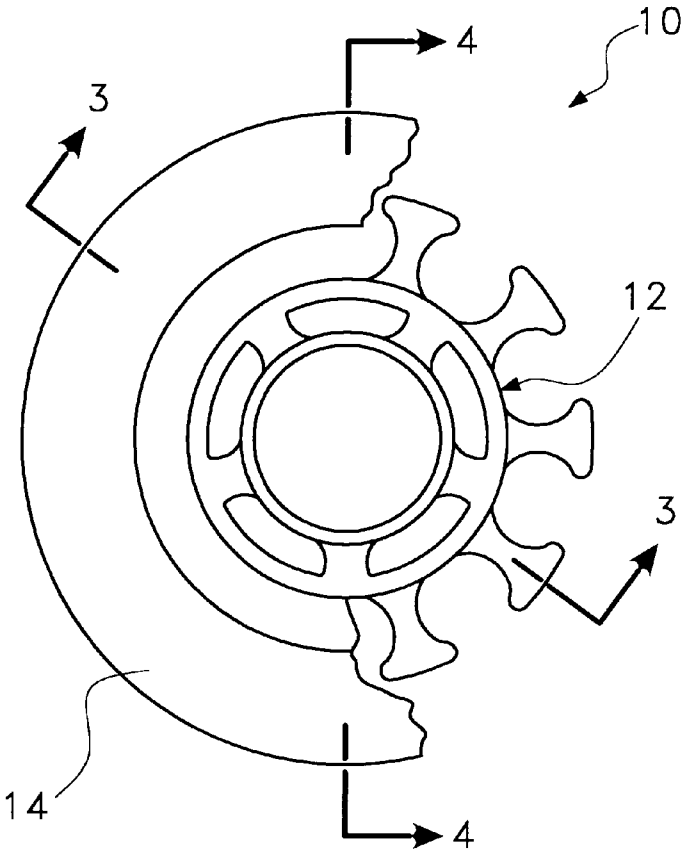
FIG. 1 is a selectively fragmented side view of an exemplary embodiment of a wheel assembly in accordance with the present invention.

Referring to FIG. 1, a first exemplary embodiment of a skate wheel assembly 10 is shown in accordance with the present invention. The skate wheel assembly 10 is comprised of a wheel 14 molded around a hub 12. The wheel 14 is molded from a plastic or synthetic rubber material. Numerous different materials, such as polyurethane, neoprene and the like have been used to form modern skate wheels. Any such material can be adapted to use with the present invention. However, a synthetic material such as a millable polyurathane elastimer is preferred.

Figure 2:
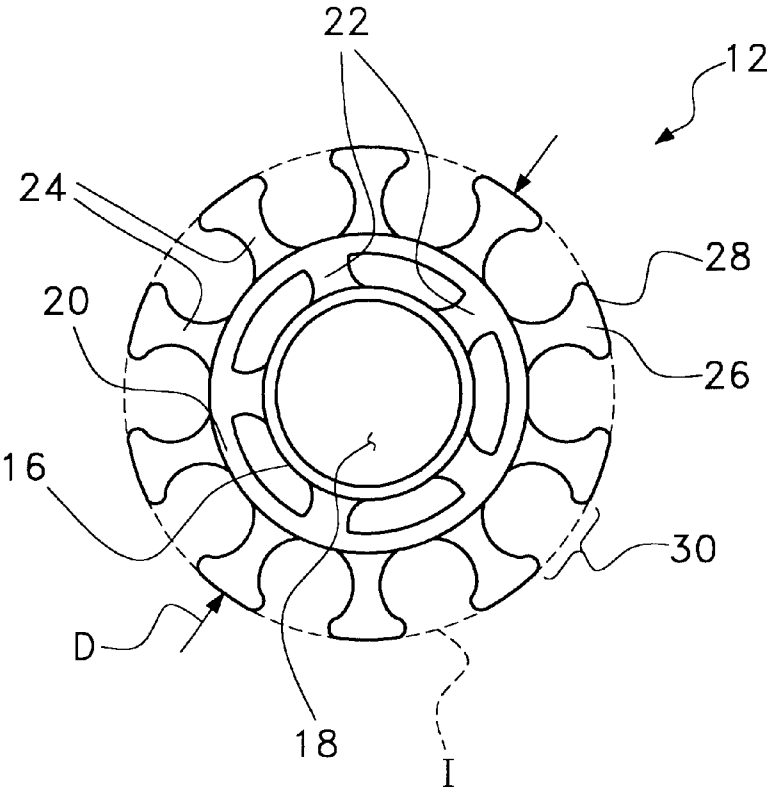
FIG. 2 is a side view of the hub assembly component of the wheel assembly shown in FIG. 1.

The hub 12 can be either molded from a rigid plastic or formed from metal. Referring to FIG. 2, it can be seen that the hub 12 contains an inner cylindrical element 16 that is concentrically positioned in the center of the hub 12. The inner cylindrical element defines a central opening 18 that is adapted to receive a typical prior art skate bearing (not shown). An outer cylindrical element 20 is concentrically positioned around the inner cylindrical element 16. The outer cylindrical element 20 is connected to the inner cylindrical element 16 by a plurality of spoke elements 22 that radially extend from the exterior of the inner cylindrical element 16 to the interior of the outer cylindrical element 20. A continuous flange can be used in place of the plurality of spoke elements 22, however, the use of spoke elements 22 is preferred because it uses less material, is less heavy and is more aesthetically pleasing than is a continuous flange.

A plurality of support elements 24 radially extend from the exterior of the outer cylindrical element 20. The support elements 24 all terminate along the line of an imaginary circle I having a diameter D and which is concentric with both the inner cylindrical element 16 and the outer cylindrical element 20. The diameter D of the imaginary circle can be between 55% and 90% of the full diameter of the wheel assembly 10 (FIG. 1). Preferably, the diameter D of the imaginary circle is between 70% and 80% of the full diameter of the wheel assembly 10 (FIG. 1).

Each of the support elements 24 has an enlarged head 26. The top surface 28 of the enlarged head 26 follows the curvature of the imaginary circle I. The enlarged head 26 of each support element 24 tapers down to a narrower shaft the extends to the exterior of the outer cylindrical element. A gap 30 exists between each adjacent support element 24. The gaps 30 between support elements 24 account for between 25% to 80% the circumference edge of the imaginary circle I. Consequently, the enlarged heads 26 of the support elements 24 account for between 20% and 75% of the circumference of the imaginary circle I.

Figure 3:
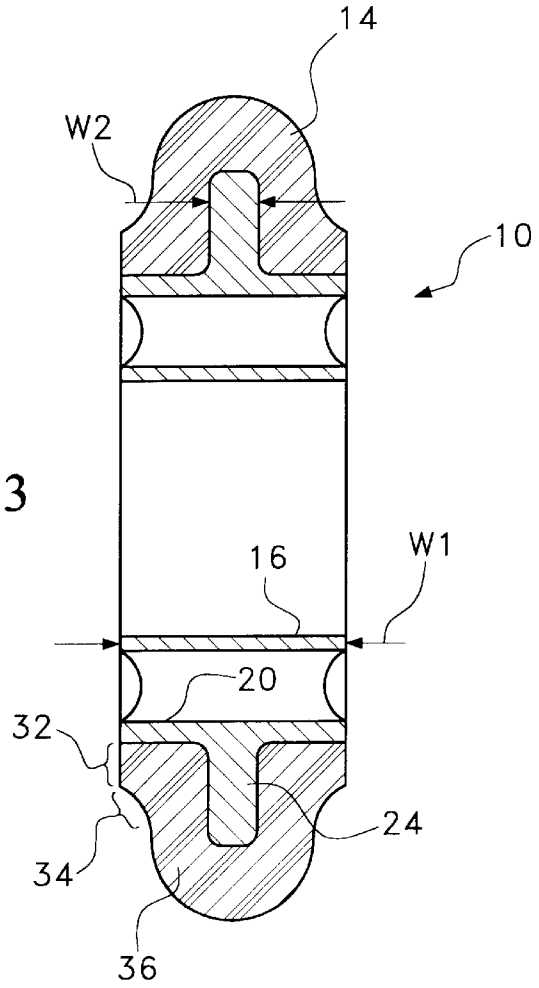
FIG. 3 is a cross-sectional view of the embodiment of FIG. 1 viewed along section line 3—3.

Referring to FIG. 3, it can be seen that the inner cylindrical element 16 and the outer cylindrical element 20 have a width W1 that is equal to the maximum width of the overall wheel assembly 10. The support elements 24 are much narrower than the inner and outer cylindrical elements 16, 20. The support elements 24 radially extend from the midpoint of the exterior of the outer cylindrical element 20. The support elements have a width W2, which is preferably less than 40% the maximum width W1 of the inner and outer cylindrical elements 16, 20.

The material of the wheel 14 is molded around the support elements 24. The wheel 14 begins at the exterior of the outer cylindrical element 20 and radially extends away from the outer cylindrical element 20. The wheel 14 contains a straight region 32 that extends straight away from the outer cylindrical element 20 at a perpendicular. The straight region 32 leads into a beveled region 34, where the width of the wheel decreases between 5% and 25%. The beveled region 34 leads into a semicircular curved region 36 that completes the profile of the wheel 14. The straight region 32, beveled region 34 and semicircular curved region 36 of the wheel 14 provide the wheel 14 with a generally bell shaped configuration.

As the wheel assembly 10 rotates on the bottom of a skate, the areas within the material of the wheel 14 that are occupied by a support element 24 periodically align with the center of gravity acting on the wheel assembly 10. Similarly, the areas of the gaps 30 (FIG. 2) between support structures 24 also periodically come into line with the center of gravity acting on the wheel assembly 10. Since the areas of the gaps 30 (FIG. 2) account for 25% to 80% of the area in question, the gaps 30 will fall into line with the center of gravity acting on the wheel assembly between 25% and 80% of the time.

Figure 4:
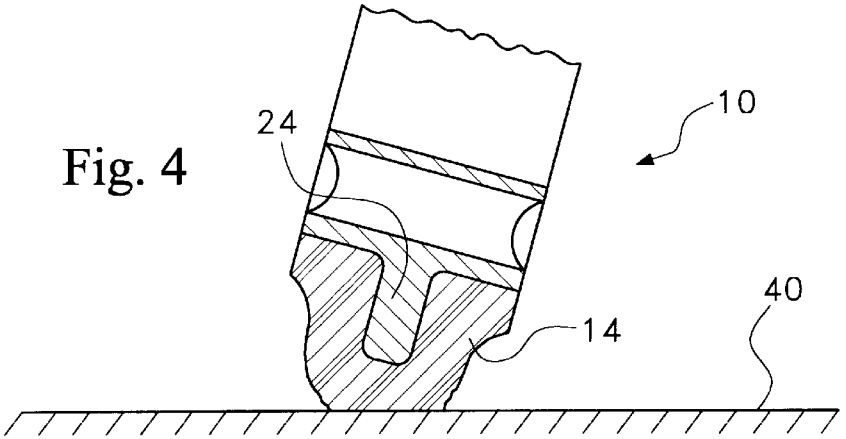
FIG. 4 is a cross-sectional view of the embodiment of FIG. 1 viewed along section line 3—3 as it would appear contacting the ground during a turn.

Referring to FIG. 4, it can be seen that when a support element 24 aligns with the center of gravity acting on the wheel assembly 10, the support element 24 reinforces the material of the wheel 14. This prevents the material of the wheel 14 from deflecting beyond a predetermined point. The result is a relatively small area of contact between the material of the wheel 14 and the below lying ground 40. Since the area of contact is small, the resulting drag due to friction is proportionately small. The low friction with the ground 40 enables the wheel assembly 10 to roll faster along the ground 40 than would otherwise be possible given the material of the wheel 14.

Figure 5:
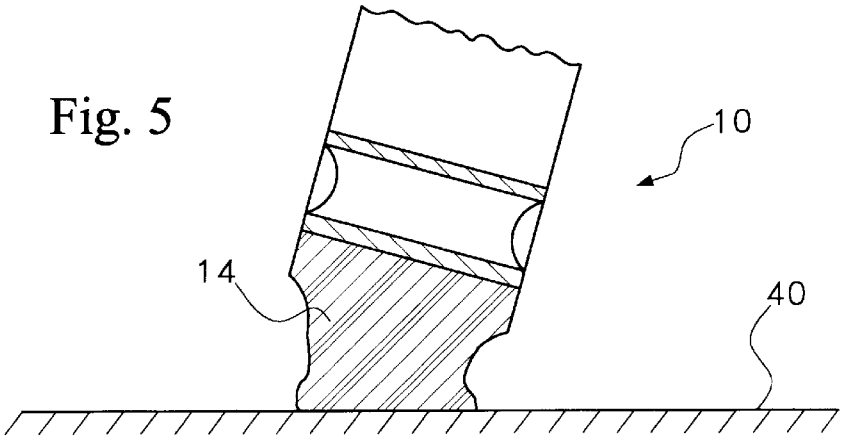
FIG. 5 is a cross-sectional view of the embodiment of FIG. 1 viewed along section line 5—5 as it would appear contacting the ground during a turn.

Referring to FIG. 5, it can be seen that when a gap 30 (FIG. 2) between support elements aligns with the center of gravity acting on the wheel assembly 10, nothing directly reinforces the material of the wheel. As a result, the material of the wheel 14 is free to deflect. The result is a relatively large area of contact between the material of the wheel 14 and the below lying ground 40. Since the area of contact is large, the resulting drag due to friction is proportionately large. The high friction with the ground 40 enables the wheel assembly to engage the ground 40 without sliding during sharp turns and sudden stops.

The areas within the wheel supported by the support elements and the areas not supported by the support elements alternate rapidly. A skate typically has a wheel assembly with a circumference of about ten inches. If a person is skating twenty miles per hour, the wheel of the skate are rotating over 2000 times per minute. This means that the areas supported and not supported by support elements are alternating several thousand times per minute. At such an alternating cycle rate, the characteristics of the supported areas and the unsupported areas become mixed in a manner that tends to optimize both characteristics. The result is wheel assembly that grips tightly in turns, yet is exceptionally fast when skating straight. The wheel assembly also exhibits long wear resistance, yet provides rapid stops without undue skidding.

It will be understood that the various figures described above illustrate only one preferred embodiment of the present invention. A person skilled in the art can therefore make numerous alterations and modifications to the shown embodiment utilizing functionally equivalent components to those shown and described. All such modifications are intended to be included within the scope of the present invention as defined by the appended claims.

What is claimed is:

1. A wheel assembly, comprising:

a hub having a predetermined width, said hub having plurality of support elements radially extending therefrom that terminate on the circumference of a common imaginary circle of a first predetermined diameter, each of said plurality of support elements having a maximum with that is less than 40% that of said predetermined width, and each of said plurality of support elements having a first end connected to said hub and a second end facing away from said hub, wherein the second end of adjacent support elements are separated by a gap; and a solid wheel molded to said hub and said plurality of support elements, wherein said solid wheel has a second predetermined diameter and said first predetermined diameter is between 70% and 90% the diameter of said second diameter.

2. The assembly according to claim 1, wherein said second end of each of said support elements terminates with an enlarged head that is curved and follows the circumference of a common imaginary circle.

3. The assembly according to claim 2, wherein the enlarged head of each of said support elements in combination account for between 20% and 75% of the circumference of said common imaginary circle.

4. The assembly according to claim 2, wherein said first predetermined diameter has a diameter that is between 80% and 90% of said second predetermined diameter.

5. The assembly according to claim 1, wherein said hub is metal.

6. The hub according to claim 1, wherein said hub further includes a first cylindrical element and a second cylindrical element concentrically position within said first cylindrical element.

7. The hub according to claim 6 wherein said first cylindrical element is coupled to said second cylindrical element by at least one spoke element.

* * * * *